United States Patent [19]

Fitzsimmons

[11] Patent Number: 4,886,150

[45] Date of Patent: Dec. 12, 1989

[54] BABY ACCESSORY CARRIER

[76] Inventor: Julie-Anna Fitzsimmons, Box 6028, Station A, Calgary, Alberta T2H 2L3, Canada

[21] Appl. No.: 197,678

[22] Filed: May 23, 1988

[51] Int. Cl.[4] ..... A45C 9/00; A45F 4/06

[52] U.S. Cl. ..... 190/1; 190/2; 5/420; 224/251; 383/4

[58] Field of Search ..... 190/1, 2, 8; 383/4; 5/417, 420; 224/251; 150/6; 5/462, 466

[56] References Cited

U.S. PATENT DOCUMENTS

| | | | |
|---|---|---|---|
| 3,041,638 | 7/1962 | Lo Vico | 190/2 X |
| 3,489,194 | 1/1970 | Hoover | 383/4 |
| 4,535,878 | 8/1985 | Grahl | 190/2 X |
| 4,566,130 | 1/1986 | Coates | 383/4 X |

FOREIGN PATENT DOCUMENTS

| | | | |
|---|---|---|---|
| 2478972 | 10/1981 | France | 190/1 |
| 87/02554 | 5/1927 | PCT Int'l Appl. | 190/2 |
| 2061712 | 5/1981 | United Kingdom | 190/2 |

*Primary Examiner*—Sue A. Weaver

[57] ABSTRACT

In general, devices for carrying the accessories required for feeding and changing babies are somewhat cumbersome and/or expensive to produce. A simple baby changing device and carrier for diapers, etc. includes an elongated, rectangular panel with a central, transversely extending change area covered by a releasable impermeable pad and bordered by a pair of pocket-containing ends, which are folded into overlapping relationship with each other and with the change area to form a small, rectangular package. The package is folded double to form a compact, purse-like article. Handles at each end of the change are, i.e. on the top end of the folded article facilitate carrying of the device.

3 Claims, 2 Drawing Sheets

BABY ACCESSORY CARRIER

BACKGROUND TO THE INVENTION

This invention relates to a baby changing device, and in particular to a combination baby changing device and diaper bag.

Actually, the device of the present invention is intended to carry all of the accessories commonly associated with baby changing. Moreover, bibs, bottles and other baby feeding equipment can be carried in the device.

In general, the accessories used to change babies when visiting or travelling are carried in a large bag or case, which may or may not be compartmented. One presently available device is in the form of a parallelopipedic suitcase which converts into a small bed/-change mattress for babies. The sides of the change area are defined by zippered compartments for diapers and other accessories. Such a device is both cumbersome and expensive to produce.

The object of the present invention is to do away with the disadvantages of the above described products by providing a relatively simple baby changing device, which doubles as a bag for accessories used to feed and change babies.

BRIEF SUMMARY OF THE INVENTION

Accordingly, the present invention relates to a portable baby changing device comprising elongated, planar body means defining first, central panel means defining a changing area; second panel means bordering one side of and integral with said first panel means; third panel means bordering the other side of and integral with said first panel means; and handle means extending outwardly from each end of said first central panel means, whereby, when said second and third panel means are folded inwardly into overlapping relationship with each other and with said central panel means, and said three panel means are folded along the centre thereof to a fully closed condition, the handle means become juxtaposed to facilitate carrying of the device.

BRIEF DESCRIPTION OF THE DRAWINGS

The invention will be described in detail with reference to the accompanying drawings, which illustrate a preferred embodiment of the invention, and wherein.

Figure 2:
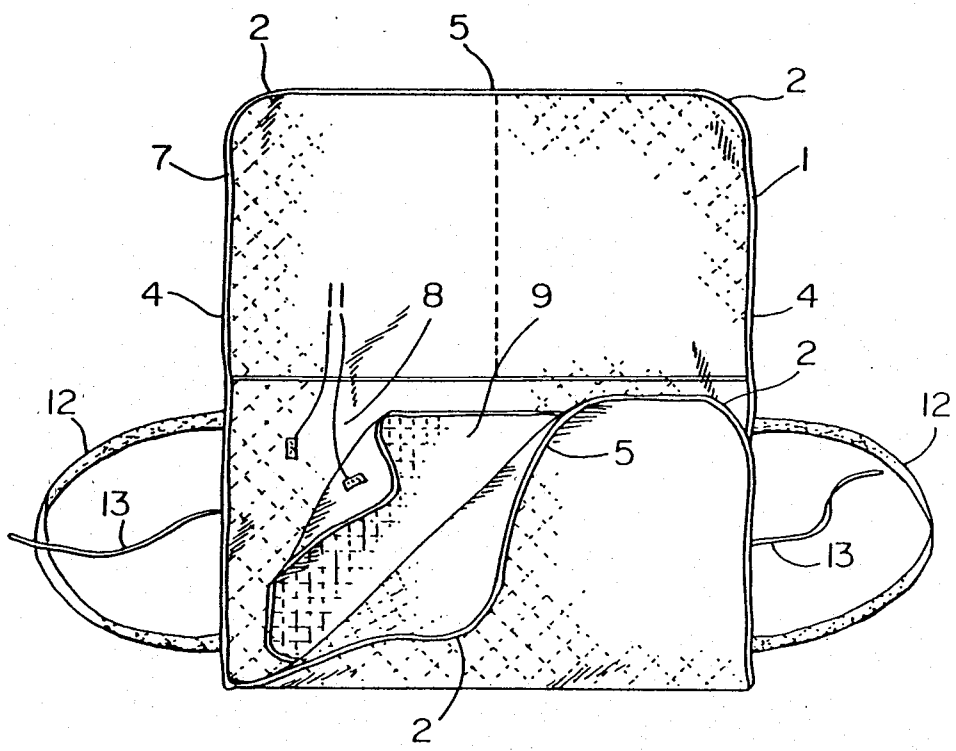
FIG. 2 is a plan view of the device of FIG. 1 in the partly opened condition.

With reference to the drawings, the device of the present invention includes an elongated, quilted, rectangular body 1 with rounded corners 2. The sides 4 and the ends 5 of the body 1 are reinforced with a fabric strip 7, which extends around the entire periphery of the body. The body 1 defines a central change panel or area 8 for receiving a separate, water impermeable change pad 9. The pad 9 is a conventional thin, quilted pad with at least one side formed of plastic or another impermeable material. The pad 9 is attached to the panel 8 by mating Velcro (trademark) strips 11.

Figure 1:
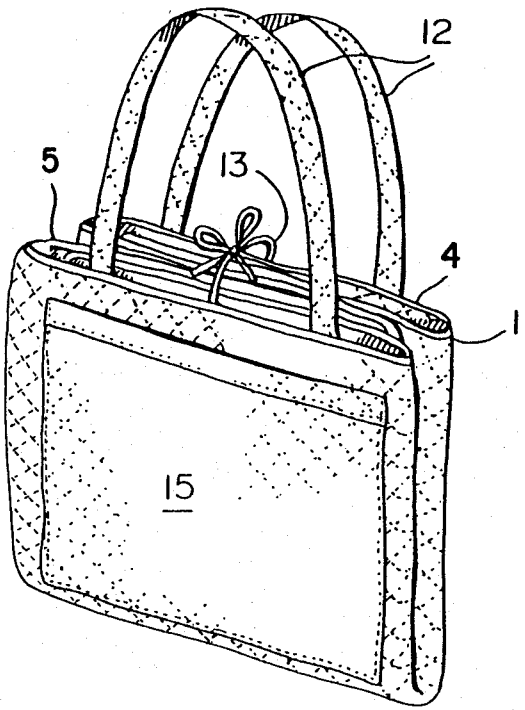
FIG. 1 is a perspective view from one end and above of a baby changing device in accordance with the present invention in the fully closed condition.
Figure 3:
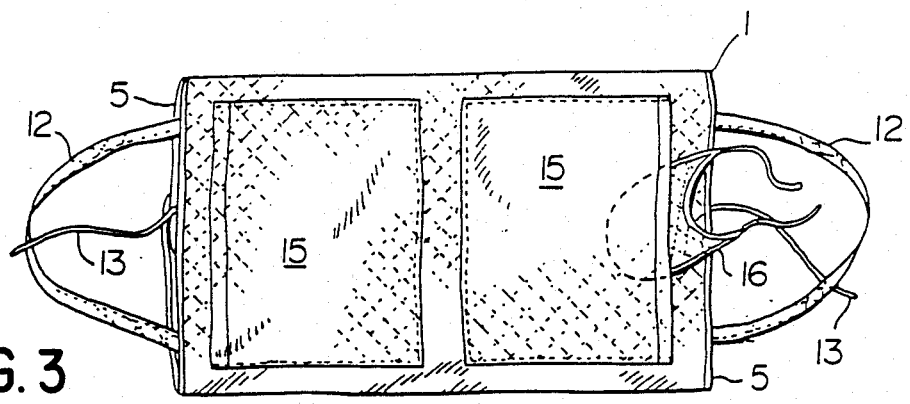
FIG. 3 is a bottom view of the device of FIGS. 1 and 2 in the partly open condition.

A generally U-shaped handle 12 is connected to each side 4 of the body 1 in the area of the panel 8, i.e. handles 12 are provided at the ends of such panel 8. Tie strips 13 are also provided at the ends of the panel 8 between the arms of the handles 12. When the device is fully closed (FIG. 1), the handles 12 are adjacent to each other for carrying the device, and the strips 13 are sufficiently close together that they can be knotted together to secure the device in the fully closed position.

A pair of large pockets 15 are provided on the rear or bottom surface of the panel 8 for carrying bibs 16 (one shown) or other baby articles. The pockets 15 are formed by separate panels of material sewn to the body 1. The pockets 15 open outwardly towards the sides 4 of the body 1, i.e. towards the ends of the panel 8 so that when the device is fully closed (FIG. 1) the pockets 15 open upwardly.

Pockets 18 are provided on each end of the body 1. The pockets 18 open inwardly towards the panel 8, and are designed to carry diapers, bottles, etc. The pockets 18 are formed by attaching large panels of material to the body 1, and sewing longitudinally extending seams 19 at appropriate locations. One seam 19 in each end extends along the longitudinal axis of the body 1 to define a fold line in each end pocket panel or area. Thus, when the pocket panels are folded during closing of the device, the centre seams 19 are located in the fold leaving the contents of the pockets 18 more or less undisturbed. The pockets 18 are maintained in the closed position by Velcro tabs 20 on the body 1 and on the inside surface of the pockets.

Figure 4:
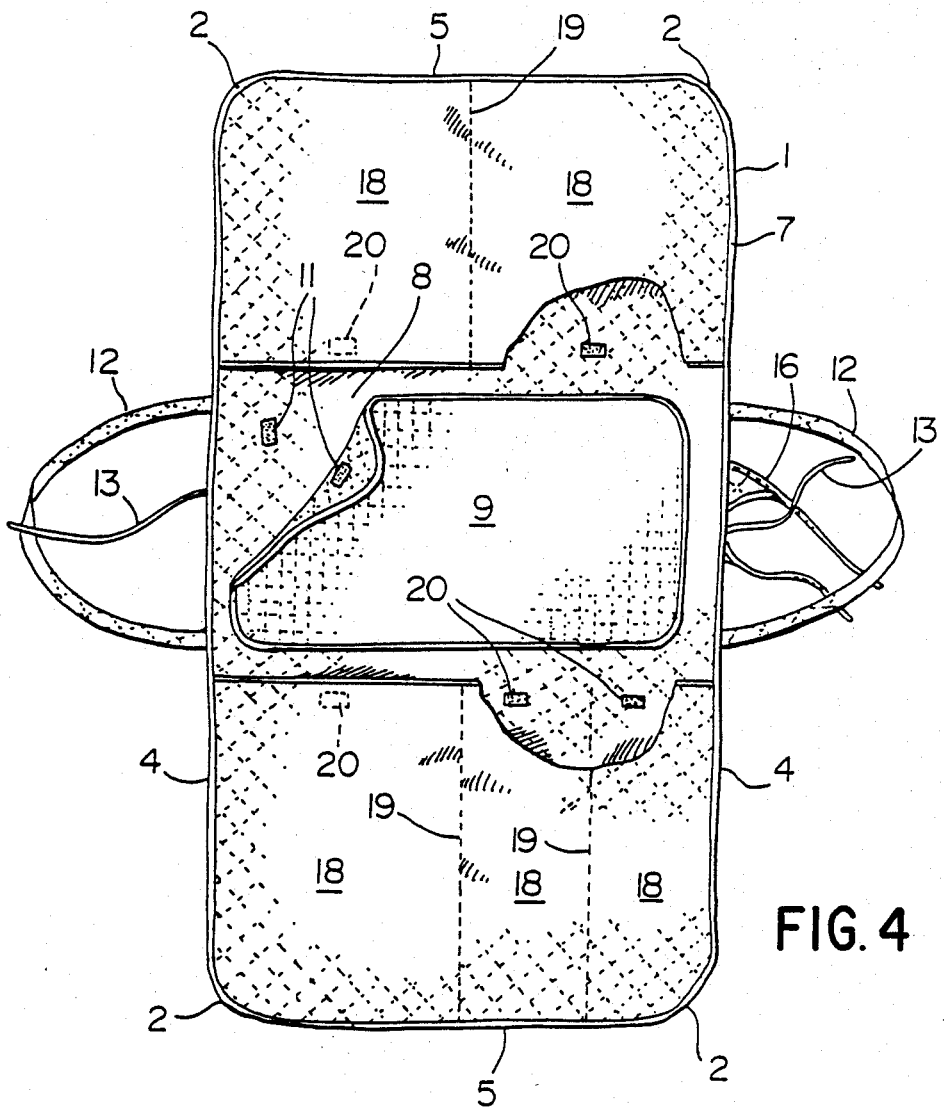
FIG. 4 is a partly sectioned, plan view of the device of FIGS. 1 to 3 in the fully open position.

In use, the device is carried in the fully closed conditions (FIG. 1) in the same manner as a purse or handbag. The resulting package is relatively compact and lightweight. In order to open the device, the tie strips 13 are unknotted, and the pocket panels are unfolded one at a time (FIG. 2) away from the central change panel 8 to the fully open position (FIG. 4). Of course, in order to close the device the above described procedure is reversed. The two pocket panels are folded inwardly into overlapping relationship with each other and with the central panel 8. All three panels are then folded along the centre thereof, so that the handles 12 become juxtaposed for carrying purposes. The tie strips 13 are then knotted together to secure the device in the fully closed position.

What is claimed is:

1. A foldable carrying device comprising:

(a) an elongated uniformly rectangular body having an inside surface and an outside surface;

(b) said body comprising, a central uniformly rectangular panel integral with a pair of opposed uniformly rectangular side panels on either side of said central panel;

(c) said central panel and said side panels being substantially equal in rectangular dimension;

(d) said central panel on the inside surface thereof, having detachably secured thereto, a rectangular water impermeable change pad, being in configuration of slightly less dimension than said central panel;

(e) each of said side panels, having permanently secured thereto on the inside of said body, rectangular pocket forming panel means, forming with a respective panel a pocket means, each substantially equal in dimension to its respective side panel;

(f) each of said pocket means having at least one opening facing toward said pad and including means for releaseably securing said pocket means in a closed condition;

(g) said central panel including opposed marginal edges;

(h) individual handle means extending outwardly from each of said marginal edges of said central panel;

(i) additional securing means extending outwardly from each of said marginal edges for securing said device together when folded for carrying;

(j) said body having, on the outside surface, at least one pocket on said central panel opening towards one of said marginal edges;

(k) said body having a longitudinal axis and being foldable along said longitudinal axis;

(l) said side panels being foldable over said central panel; and, (m) said central and side panels being foldable together along said longitudinal axis.

2. The foldable carrying device of claim 1, further including on the outside surface of said central panel, a second pocket.

3. The foldable carrying device of claim 1, further including, said securing means being located centrally of said handle means for securing the device in a folded condition.

* * * * *